US005603427A

United States Patent [19]

Truchon et al.

[11] Patent Number: 5,603,427

[45] Date of Patent: Feb. 18, 1997

[54] ACCESS DOOR CONSTRUCTION FOR A HOT WATER TANK ASSEMBLY

[76] Inventors: Michael Truchon, Rte. 1, Box 123, Chancellor, Ala. 36316; B. Wayne Folsom, 3304 Sharer Rd., Tallahassee, Fla. 32312

[21] Appl. No.: 342,916

[22] Filed: Nov. 21, 1994

Related U.S. Application Data

[63] Continuation-in-part of Ser. No. 172,541, Dec. 23, 1993, Pat. No. 5,443,041.

[51] Int. Cl.[6] ..... B65D 90/66

[52] U.S. Cl. ..... 220/465; 220/328

[58] Field of Search ..... 220/465, 327, 220/328, 601

[56] References Cited

U.S. PATENT DOCUMENTS

| | | | |
|---|---|---|---|
| 589,528 | 9/1897 | Hegewald | 220/601 |
| 2,199,065 | 4/1940 | Bell | 220/328 |
| 3,043,467 | 7/1962 | Schwebel | 220/14 |
| 3,349,951 | 10/1967 | Peterson | 220/465 |
| 4,145,800 | 3/1979 | Scholz et al. | 220/327 |
| 4,537,329 | 8/1985 | Norton | 220/465 |
| 5,149,105 | 9/1992 | Beaver et al. | 220/465 |

FOREIGN PATENT DOCUMENTS

| | | | |
|---|---|---|---|
| 865392 | 5/1941 | France | 220/601 |

*Primary Examiner*—Stephen J. Castellano
*Attorney, Agent, or Firm*—Carnes, Cona and Dixon

[57] ABSTRACT

The present invention provides for an access door construction that is used with hot water tank assemblies that include an access opening in the inner tank and an access opening in the outer tank. The access door construction includes a first clamp that is interiorly located in the inner tank and is used to cover the first opening and a second clamp that is exteriorly located on the outer tank and is used to cover the second opening. A threaded rod is located between the first and second clamps to provide for the first and second clamps to be connect and to be a one piece structure. Centrally located on the first clamp is a circular groove while centrally located in the second clamp is a threaded through hole. The rod includes a handle at one end and a ball at its opposite end to provide for the ball to be located in the groove and for the opposite end extend through the hole. This design and configuration will permit for the ball end of the rod to rotate freely about groove and will enable the handle to move the second clamp towards or away from the outer tank. Once in place, the access door will provide for the first clamp to be securely fastened interiorly within the inner tank and the second clamp will be exteriorly secured to the outer tank.

12 Claims, 3 Drawing Sheets

ACCESS DOOR CONSTRUCTION FOR A HOT WATER TANK ASSEMBLY

This is a continuation-in-part of application Ser. No. 08/172,541, filed Dec. 23, 1993 now U.S. Pat. No. 5,443,041.

BACKGROUND OF THE INVENTION

1. Field of the Invention

The present invention provides for an access door construction for a hot water tank assembly and more particularly to an access door construction that can be used with a hot water tank assembly having dual openings.

2. Description of Background Art

Through out the United States, efforts are being taken for those who wish to save money on the hot water bill. One simple solution is to periodically remove the sediment within a hot water tank assembly, thereby preventing an accumulation within the inner tank and a buildup on the heating elements located within the inner tank. Accordingly, efforts have been made to provide for a hot water heater assembly to have an access opening on the outer tank and an access opening on the inner tank to permit for an individual to remove sediment from inner tank.

For example, U.S. Pat. No. 3,043,467 issued to Schwebel discloses a hot water tank assembly including a first opening within the inner tank with a first closure clamp that is attached by screws and a second opening within the outer tank with a second closure clamp that is attached by screws. This type of closure system requires an individual to remove or replace each screw independently when it is desired to remove or replace the closure clamp. This type of a closure system is very time consuming. Additionally, since several elements are unassembled (screws), there is a possibility and chance that the elements can be lost or rolled under the tank itself. Thereby rendering the door assembly to be useless. Further, Schwebel's closure clamp can still be opened even if water is located within the inner tank, which can prove to be extremely dangerous and harmful.

None of these previous efforts, however, provide the benefits intended with the present invention. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides for a simple and easy means for opening and closing a pair of access ports that is used in a hot water tank assembly. The process of periodically cleaning and removing the waste and debris from the hot water tank decreases sediment buildup on the heating elements allowing them to operate more efficiently and at a lower cost. The life spans of the heating elements and the hot water tank assembly are increased.

This access door construction is to be used with a water tank assembly that includes a heating element, a housing having an inner tank, an outer tank and an insulating material located between the two tanks, a first opening located in the inner tank and a second opening located in the outer tank.

The first embodiment of the access door construction of the present invention consists of a first metal clamp, a second metal clamp, and a connection therebetween. The first clamp covers the first opening in the inner tank while the second clamp covers the opening in the outer tank. This first clamp is internally located within the inner tank. Centrally located on the first clamp is a circular groove while centrally located in the second clamp is a threaded through hole. An elongated rod having a handle at one end and a ball at its opposite end extends from the first clamp to the second clamp. The threaded rod extends through the opening of the second clamp to permit for the ball to be received in the groove of the first clamp.

This design and configuration will permit for the ball end of the rod to rotate freely about groove and will enable a user to force the second clamp towards the outer tank. Once in place, the access door will provide for the first clamp to be securely fastened interiorly within the inner tank and the second clamp will be exteriorly secured to the outer tank. This arrangement will guarantee that the access door of the present invention will not be opened if the tank is filled with water. Additionally this arrangement also provides for the access door construction to be a single unit that will permit for the first and second clamps to be removed simultaneously.

A second embodiment for the access door construction of the present invention consists of a first clamp that is secured to the first opening of the inner tank and a second clamp that is secured to the second opening of the outer tank. The openings of the tank, in this embodiment, are tapped in order to provide for the holes to be threaded. Accordingly, the first clamp is threadably secured to the first opening and the second clamp is threadably secured to the second opening.

The second embodiment of the present invention provides two clamps of identical shape and construction. Each clamp includes a circular plate having an inner surface and an outer surface. The inner surface includes a first threaded extension that is inserted into the threaded opening. The outer surface includes a second extension which acts as a handle and permits for an individual to merely turn the plate in order to replace or remove the clamp.

Accordingly, it is the object of the present invention to provide for an access door that is easy to use and does not permit for an individual to open the access door when the tank is filled with water.

It is yet another object of the present invention to provide for an access door that requires minimal components and is effortless in use.

Still another object of the present invention is to provide for an access door that can be retrofitted into an existing hot water assembly.

A final object of the present invention, to be specifically enumerated herein, is to provide an access door construction for a hot water tank assembly in accordance with the preceding objects and which will conform to conventional forms of manufacture, be of simple construction and easy to use so as to provide a device that would be economically feasible, long lasting and relatively trouble free in operation.

Although there have been a few inventions related to an access door construction for a hot water tank assembly none of the inventions have become sufficiently compact, low cost and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, other objects and a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1A:
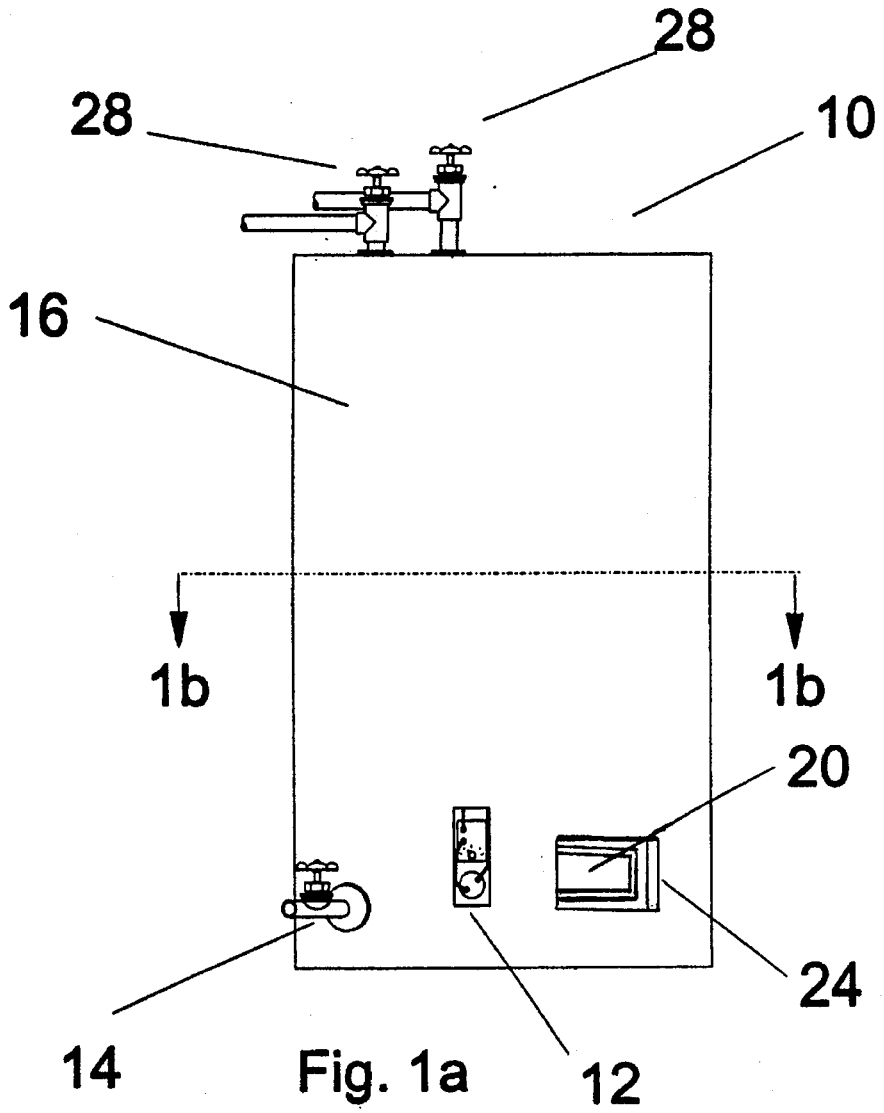
FIG. 1*a* is front view of the hot water tank assembly which will be used the access door of the present invention.
Figure 1B:
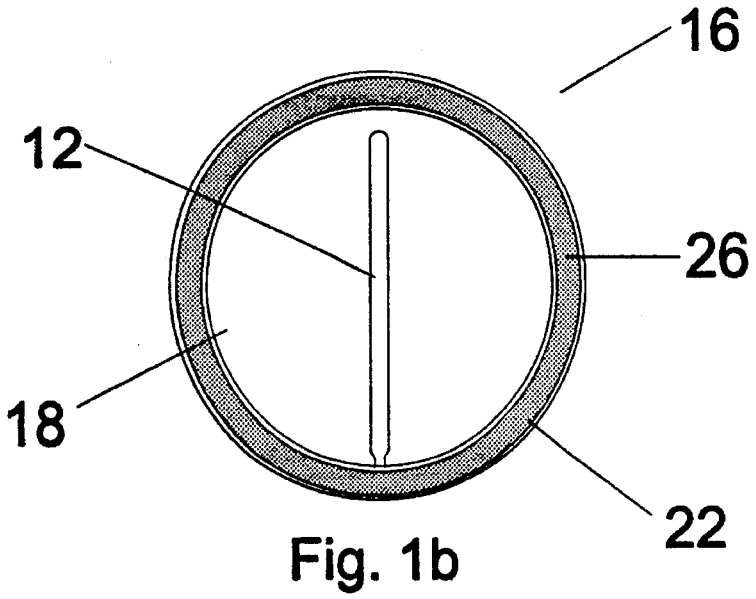
FIG. 1*b* is a top view of the hot water tank assembly taken along lines 1*b*–1*b* of figure 1*a*.
Figure 2A:
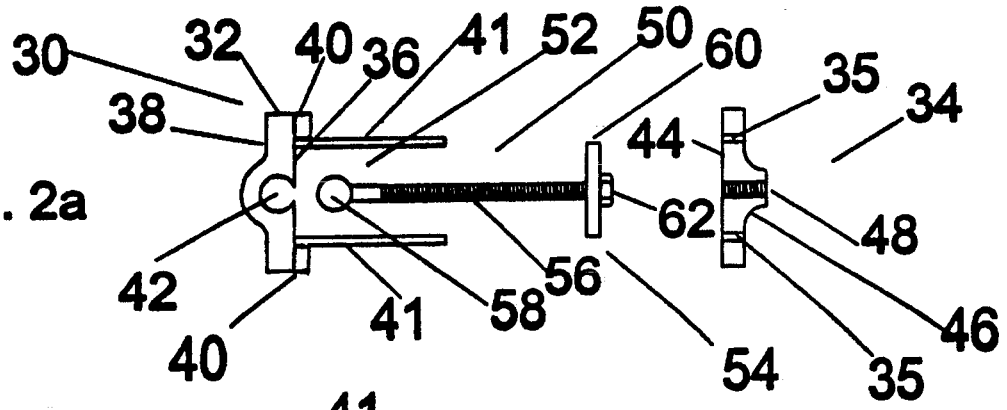
FIG. 2*a* is a side view of the access door, prior to assembly, of the first embodiment of the present invention.
Figure 2B:
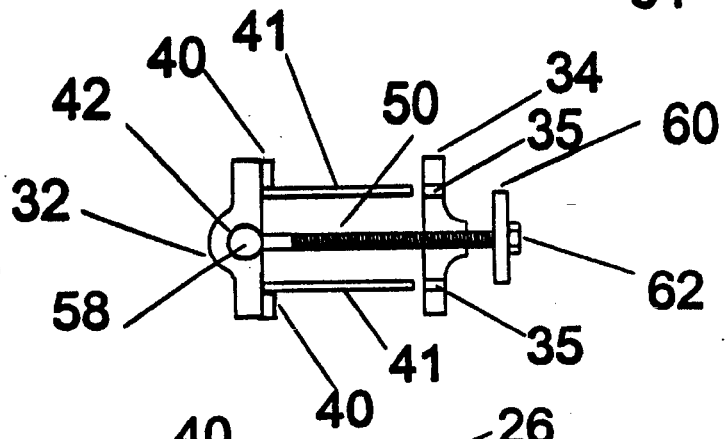
FIG. 2*b* is a side view of the access door of the first embodiment of the present invention.
Figure 2C:
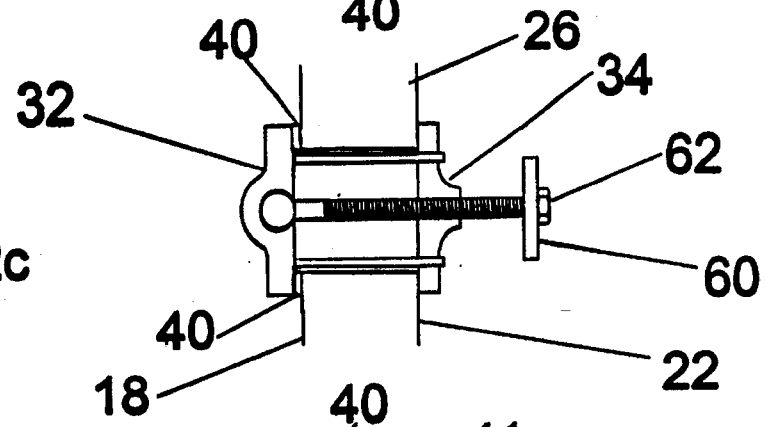
FIG. 2*c* is a cross sectional view of the access door of the first embodiment of the present invention installed on a hot water tank assembly.
Figure 2D:
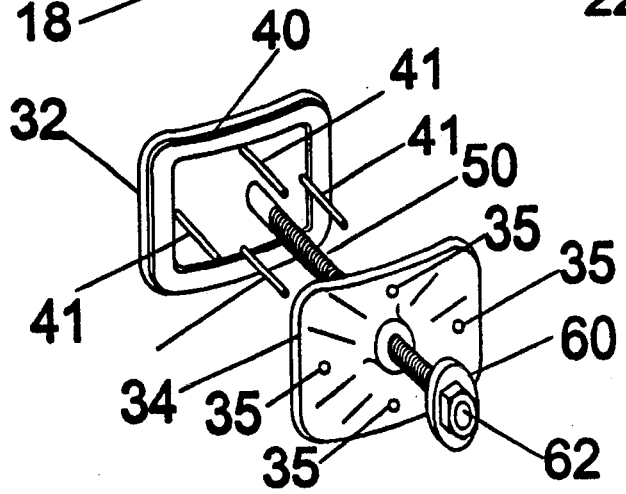
FIG. 2*d* is a perspective view of the access door of the first embodiment of the present invention.

As illustrated in figures 1*a* and 1*b*, the access door of the present invention will be used with a hot water tank assembly 10 which consists of a conventional heating element 12, a water drain device 14, an inlet and outlet 28, and a housing 16. The housing further includes an inner tank 18 having a first opening 20 and an outer tank 22 having a second opening 24. An insulating layer 26 is located between the inner tank 18 and the outer tank 22. These openings 22 and 24 are covered with the access door of the present invention.

The first embodiment of the access door 30 of the present invention is illustrated in FIGS. 2*a*–2*d*. As illustrated the access door 30 of the first embodiment consists of a first clamp 32 and a second clamp 34. This first clamp 32 is situated inside the inner tank 18 while the second clamp 34 is situated outside the outer tank 22 once the access door 30 is secured to the tank assembly. Both the first and second clamps are larger in size than the openings of the inner and outer tanks.

The first clamp 32 includes an inner surface 36 and an outer surface 38. The inner surface 36 contacts the interior portion of the inner tank 18 when the first clamp is secured to the hot water tank assembly. The outer surface is in direct communication with the water of the assembly.

A first gasket 40 is located directly on the periphery of the inner surface 36 of the first clamp. This gasket 40 acts as a sealing means and prevents the water from the hot water tank assembly from leaking out of the opening. This location also provides for the gasket to be easily replaced once it is worn. Optionally, a frame (not illustrated) can be located on the periphery of the inner surface 36 of the first clamp 32. The gasket 40 can then be attached to the frame.

Centrally located in the inner surface of the first clamp 32 is a first circular groove The second clamp 34 includes an inner surface 44 and an outer surface 46. The inner surface 44 contacts the exterior portion of the outer tank 22 when the second clamp 34 is secured to the hot water heater assembly. The inner surface 36 of the first clamp 32 faces the inner surface 44 of the second clamp 34. Centrally located in the second clamp 34 is a threaded aperture 48.

A rod 50 is located between the first clamp 32 and second clamp 34. This rod 50 is threaded and includes a first end 52, a second end 54, and a middle portion 56. The first end 52 includes a ball 58. This ball 58 is received in the circular groove 42 of the first clamp 32. This will provide for the first end 52 to have a ball and joint socket. This arrangement will permit for the first clamp to move and rotate freely about the rod The middle portion 56 of the rod 50 is located between the inner surfaces of the first clamp and second clamp.

The second end 54 receives the threaded aperture 48 of the second clamp 34. This second end 54 further includes a handle 60 that faces the outer surface 46 of the second clamp 34. Centrally located on and extending outwardly from the handle is a hex nut 62. This hex nut 62 will provide the option of permitting an individual to use a wrench-like device in order to secure or remove the access door 30 from the hot water tank assembly.

In order to remove and utilized this first embodiment of the present invention, the handle 60 or optionally the wrench-like device is used on the hex nut 62 in order turned and loosen the second clamp 34. Upon turning the handle or wrench-like device, the second clamp 34 moves along the middle portion of the threaded rod 50 towards the handle 60 while the second end 54 of the rod moves freely within the groove 42 of the first clamp 32. This loosing will permit for the first clamp 32 to move about the rod 50 so that it can be removed from the inner tank 18. Once the access door 30 is removed an individual can easily, quickly, and efficiently remove the sediment from the interior area of the inner tank 18.

In order to install the first embodiment of the present invention, the first clamp 32 is inserted into the first opening of the inner tank be. The handle or wrench-like device is used to turn the threaded rod 50 to provide for the second clamp 34 to move towards the second opening. Once contact between the inner surface 44 of second clamp 34 and the outer surface of the outer tank 22 is made, then the first clamp and second clamp are securely fastened to the tank and are held in place by force.

This arrangement and design will permit for easily installation or removal of the access door of the present invention. Additionally, with this design and configuration there is included an inherent safety feature. This safety feature is that an individual will not be able to open the door if the tank is filled with water.

This first embodiment can be altered to include a plurality of pins 41 that extend outwardly and perpendicularly from the inner surface 36 of the first clamp 32. The inner surface 44 of the second clamp 34 would include a plurality of holes 35 that correspond to the plurality of pins. In this arrangement, the pins 41 will engage with the holes 35 to provide for the first clamp 32 to be correctly aligned with respect to the opening of the inner tank 18.

Figure 3:
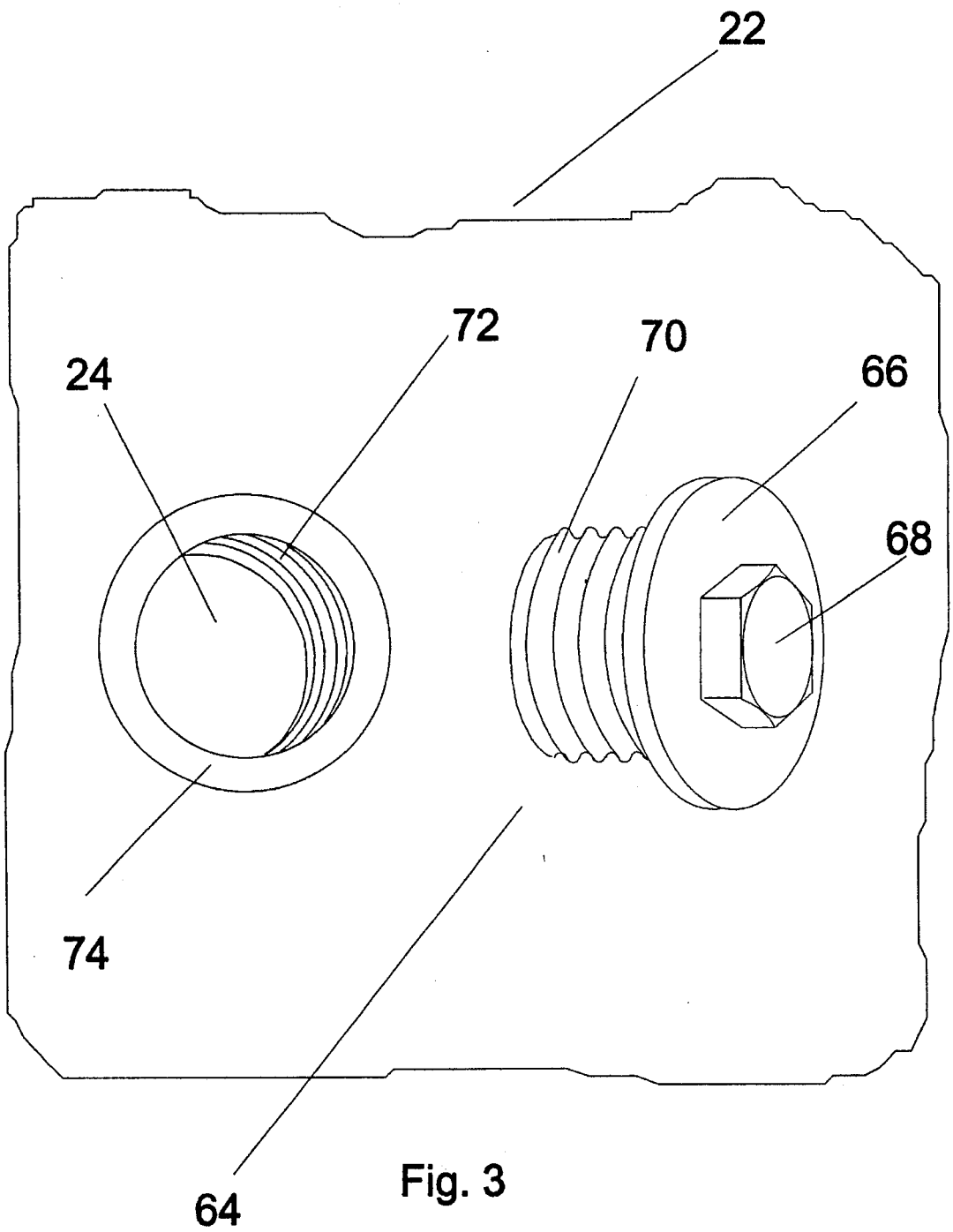
FIG. 3 is a perspective view of the second embodiment of the access door of the present invention.

The second embodiment of the present invention is illustrated in further detail in FIG. 3. It is noted that the first clamp that is used within the opening of the outer tank is illustrated and that the second clamp used for the opening of the inner tank is not separately illustrated in detail in that it is identical in design to the first clamp.

As seen in FIG. 3, the opening 24 of the water tank 22 is tapped to provide for the opening 24 to be internally threaded 72. A gasket 74 is located on the periphery of the opening 24. The second embodiment for the clamp 64 includes a circular plate 66 having an inner surface and an outer surface. Attached perpendicularly to the inner surface is a threaded shaft 70. This threaded shaft is received within the threaded opening 72 to provide for the opening to be sealed. Centrally located on and extending outwardly from the outer surface of the plate 66 is a first handle (not illustrated). A hex nut 68 is centrally located on and extends outwardly from the handle. This hex nut will provide the option of permitting an individual to use a wrench-like device in order to secure or remove the access door from the hot water tank assembly.

While the invention has been particularly shown and described with reference to an embodiment thereof, it will be understood by those skilled in the art that various changes in form and detail may be made without departing from the spirit and scope of the invention.

We claim:

1. An access door construction for a hot water tank assembly comprising in combination:

a first clamp is internally located in an inner tank and is used to cover and seal a first opening of said hot water tank assembly when said access door construction is attached thereto;

a second clamp is exteriorly located in an outer tank and is used to cover and seal a second opening in said outer tank of said hot water tank assembly when said access door construction is attached thereto;

a rod having a first end is attached to said first clamp and a second end extends through said second clamp;

said first clamp is pivotally secured to said first end of said rod via a pivot means and said pivot means includes a ball and a groove, said ball is located on said first end of said rod, said groove is located in an inner surface of said first clamp, and said ball is located in said groove;

a handle is located on said second end of said rod for activating a releasing and securing means; and said releasing and securing means simultaneously provides for said first clamp to be interiorly and releasably secured to said inner tank and for said second clamp to be exteriorly and releasably secured to said outer tank for enabling removal and securement of said first clamp and said second clamp to occur exteriorly.

2. An access door construction as in claim 1 wherein said rod is threaded and said groove is centrally located in said first clamp a threaded through hole is centrally located in said second clamp, said second end of said rod extends through said threaded through hole, said threaded through hole and said rod being threaded constitutes said releasing and securing means, and wherein said handle permits for said releasing and securing means to loosen or secure said first clamp to said first opening and said second clamp to said second opening and by rotating said handle for securing said first clamp and said second to said hot water tank assembly provides for said rod to rotate to provide for said second clamp to move towards the second opening and for said inner surface of said first clamp to interiorly contact said inner tank, rotating said rod is continued until said second clamp contacts said outer tank for rendering said first clamp and said second clamp to be securely fastened to said hot water tank assembly by force.

3. An access door construction as in claim 1 wherein said inner surface of said first clamp includes a gasket.

4. An access door construction as in claim 2 wherein said handle further includes a hex nut that extends outwardly from a top surface of said handle for permitting an option of using a wrench-like device to activate said releasing and securing means.

5. An access door construction as in claim 1 wherein said inner surface of said first clamp includes a plurality of pins and said plurality of pins extend perpendicularly from said inner surface and said second clamp includes a plurality of holes that correspond to said plurality of pins and said plurality of holes receive said pins when said access door construction is secured to said hot water tank assembly.

6. An access door construction as in claim 1 wherein a gasket is secured to said first clamp.

7. An access door construction for a hot water tank assembly comprising in combination:

a first clamp is internally located in an inner tank and is used to cover and seal a first opening of said hot water tank assembly when said access door construction is attached thereto;

a second clamp is exteriorly located in an outer tank and is used to cover and seal a second opening in said outer tank of said hot water tank assembly when said access door construction is attached thereto;

a rod having a first end is attached to said first clamp and a second end extends through said second clamp;

said first clamp is pivotally secured to said first end of said rod via a pivot means and said pivot means includes a ball and a groove, said ball is located on said first end of said rod, said groove is located in an inner surface of said first clamp, and said ball is located in said groove;

a triggering means is located on said second end of said rod for activating a releasing and securing means; and said releasing and securing means simultaneously provides for said first clamp to be interiorly and releasably secured to said inner tank and for said second clamp to be exteriorly and releasably secured to said outer tank for enabling removal and securement of said first clamp and said second clamp to occur exteriorly.

8. An access door construction as in claim 7 wherein said triggering means is a handle.

9. An access door construction as in claim 7 wherein said second end of said rod is threaded and is received within a threaded through hole located in said second clamp, said triggering means permits for said releasing and securing means to loosen or secure said first clamp to said first opening and said second clamp to said second opening and by activating said triggering means for securing said first clamp and said second clamp to said hot water tank assembly provides for said rod to rotate to provide for said second clamp to move towards the second opening and for said inner surface of said first clamp to interiorly contact said inner tank, rotating said rod is continued until said second clamp contacts said outer tank for rendering said first clamp and said second clamp to be securely fastened to said hot water tank assembly by force.

10. An access door construction as in claim 7 wherein a gasket is secured to said first clamp.

11. An access door construction as in claim 7 wherein said triggering means is a hex nut that extends outwardly from said second end of said rod for enabling a wrench-like device to cause said rod to rotate.

12. An access door construction as in claim 9 wherein said triggering means is a handle.

* * * * *